US008469354B2

(12) United States Patent
Kobayashi

(10) Patent No.: US 8,469,354 B2
(45) Date of Patent: Jun. 25, 2013

(54) DRIVE MECHANISM AND IMAGE FORMING APPARATUS

(75) Inventor: Tatsuya Kobayashi, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 13/297,599

(22) Filed: Nov. 16, 2011

(65) Prior Publication Data

US 2012/0126474 A1 May 24, 2012

(30) Foreign Application Priority Data

Nov. 19, 2010 (JP) ..... 2010-258871
May 6, 2011 (JP) ..... 2011-103658

(51) Int. Cl.
*B65H 5/22* (2006.01)
*B65H 83/00* (2006.01)

(52) U.S. Cl.
USPC ..... 271/10.05; 271/264; 192/3.51

(58) Field of Classification Search
USPC .... 271/10.05, 264; 399/388; 310/103; 74/63, 74/606 R; 192/3.51
See application file for complete search history.

(56) References Cited

U.S. PATENT DOCUMENTS 5,149,217 A 9/1992 Narita
5,562,280 A 10/1996 Niimura et al.
6,142,276 A * 11/2000 Pinschmidt et al. ..... 192/30 W
2004/0055845 A1* 3/2004 Friedrich et al. ..... 192/70.2
2005/0018938 A1 1/2005 Rajaniemi
2007/0137975 A1* 6/2007 Tanaka et al. ..... 192/105 BA
2007/0231033 A1 10/2007 Okazaki

FOREIGN PATENT DOCUMENTS

JP 6-59567 3/1994
JP 2007-292124 11/2007
JP 2008-302548 12/2008
KR 10-570503 1/2006

* cited by examiner

*Primary Examiner* — David H Bollinger
(74) *Attorney, Agent, or Firm* — Gerald E. Hespos; Michael J. Porco; Matthew T. Hespos

(57) ABSTRACT

A drive mechanism for transmitting a drive force to drive a processing apparatus which carries out a prescribed process. The drive mechanism includes an output portion, an electromagnetic clutch and a case. An output portion for outputting the drive force, an electromagnetic clutch for controlling transmission of the drive force to the output portion, and a case including a first storage section which defines a first storage room to store the output portion, and a second storage section which defines a second storage room to store the electromagnetic clutch. Additionally, the second storage section includes a peripheral wall which surround the electromagnetic clutch, and a supporting wall which supports the electromagnetic clutch. The peripheral wall includes an upper wall above the electromagnetic clutch and a lower wall below the electromagnetic clutch. An opening section is formed in the upper wall.

7 Claims, 8 Drawing Sheets

DRIVE MECHANISM AND IMAGE FORMING APPARATUS

BACKGROUND OF THE INVENTION

1. Field of the Invention

The present disclosure is related to a drive mechanism for transmitting a drive force to drive a processing apparatus and an image forming apparatus for forming an image on a sheet by means of the drive mechanism.

2. Description of the Related Art

An image forming apparatus such as copying machines, printers, facsimile machines and composite machines with their functions includes a conveyance portion which conveys sheets, and a drive mechanism which transmits a drive force to drive an image forming mechanism for forming images on the sheets. The drive mechanism typically includes an electromagnetic clutch which controls transmission of the drive force and a cover which prevents chips caused by wearing during operations of the electromagnetic clutch. Since the cover prevents the wear chips from scattering, it becomes less likely that gears around the electromagnetic clutch and other drive elements are worn.

The cover surrounding the electromagnetic clutch suppresses dissipation of heat generated by the electromagnetic clutch. Accordingly, temperature around the electromagnetic clutch goes up. The high temperature environment around the electromagnetic clutch causes malfunctions of the electromagnetic clutch and the drive elements around the electromagnetic clutch (for example, abnormal noise due to variation in meshing amounts between gears).

SUMMARY OF THE DISCLOSURE

It is an object of the present disclosure to provide a drive mechanism and an image forming apparatus which facilitate appropriate dissipation of the heat from the electromagnetic clutch.

The drive mechanism for transmitting a drive force to drive a processing apparatus which carries out a prescribed process according to one aspect of the present disclosure includes an output portion, an electromagnetic clutch and a case. The output portion configured to output the drive force. The electromagnetic clutch configured to control transmission of the drive force to the output portion. The case including a first storage section which defines a first storage room to store the output portion, and a second storage section which defines a second storage room to store the electromagnetic clutch. Additionally the second storage section includes a peripheral wall which projects outwards from the first storage section to surround the electromagnetic clutch, and a supporting wall which supports the electromagnetic clutch. The peripheral wall includes an upper wall above the electromagnetic clutch and a lower wall below the electromagnetic clutch. An opening section is formed in the upper wall.

An image forming apparatus for forming an image according to another aspect of the present disclosure includes an image forming unit, a conveyance portion and the drive mechanism. The image forming unit configured to form an image on a sheet. The conveyance portion configured to convey the sheet to the image forming unit. The drive mechanism configured to transmit a drive force to the conveyance portion.

DESCRIPTION OF THE PREFERRED EMBODIMENTS

Various embodiments of an image forming apparatus are described with reference to the accompanying drawings. Directional terms such as "up", "down", "left" and "right" used hereinafter are merely intended to clarify the descriptions, and do not in any way limit principles of the drive mechanism or the image forming apparatus. In the following descriptions, the term "sheet" means copy paper, coated paper, OHP sheet, thick paper, card, tracing paper, or another sheet material which is subjected to an image forming process. The terms "upstream", "downstream" or similar terms used in the following descriptions mean "upstream", "downstream", and similar concepts in the sheet conveyance direction.

Figure 1:
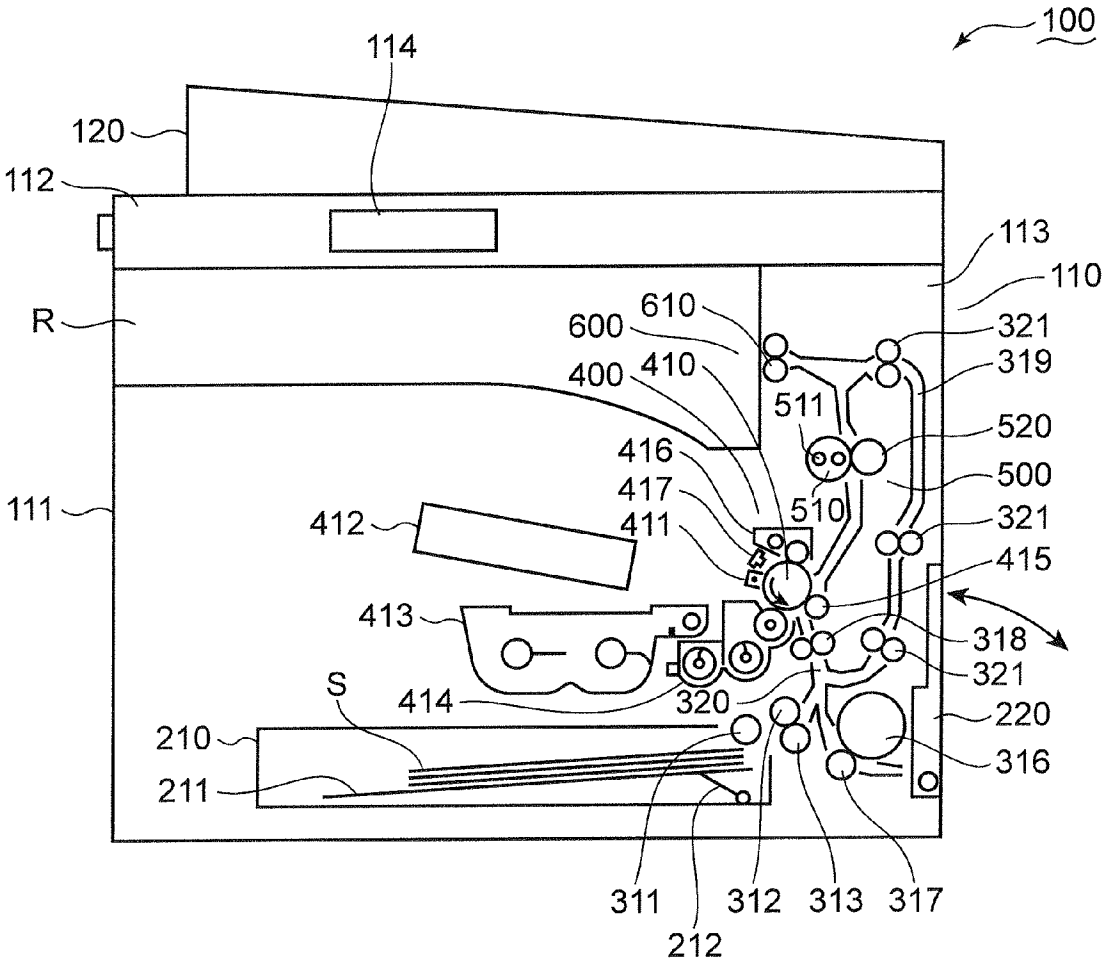
FIG. 1 is a schematic view of an image forming apparatus according to one embodiment.

FIG. 1 shows a schematic view of an image forming apparatus according to one embodiment. In the present embodiment, a copying machine is exemplified as the image forming apparatus. Alternatively, the image forming apparatus may be a printer or a facsimile device, a composite machine with their functions, or another apparatus configured to form images on sheets.

(Entire Structure of Image Forming Apparatus)

The copying machine 100 includes a main housing 110 which stores devices used to form toner images, and an original document feeder 120 which is situated on the upper surface of the main housing 110. The main housing 110 includes a lower housing 111, an upper housing 112 situated above the lower housing 111, and a connection housing 113 arranged between the lower and upper housings 111, 112. A sheet S subjected a printing process is ejected to a space R which is surrounded by the lower housing 111, the upper housing 112 and the connection housing 113.

The upper housing 112 mainly stores devices configured to read the original document which is used for a base of a toner image. The lower housing 111 stores devices configured to form the toner image on a sheet S. The connection housing 113 stores devices configured to eject the sheet S on which the toner image is formed. The copying machine 110 further includes an operation panel (not shown) which is mounted on the outer surface of the main housing 110. A user may operate the operating panel to input desired instructions to the copying machine 100.

The original document feeder 120 situated on the main housing 110 may be vertically rotated. The user may set a desired original document to the original document feeder 120. The user may then operate the operating panel to activate the original document feeder 120 and feed the original document between the lower surface of the original document feeder 120 and the upper surface of the main housing 110. Alternatively, the user may rotate the original document feeder 120 upwards to set the original on the upper surface of the main housing 110 and then rotate the original document feeder 120 downwards, so that the original document is set between the upper surface of the main housing 110 and the lower surface of the original document feeder 120.

The copying machine 100 further includes a scanner 114 configured to scan and read the original document between the upper surface of the main housing 110 and the lower surface of the original document feeder 120. The scanner 114 is situated inside the upper housing 112. The scanner 114 optically scans and reads the image on the original document. Then, the scanner 114 outputs the read image as digital signals.

The copying machine 100 further includes a cassette 210 which stores sheets S on which toner images are formed in response to the digital signals output from the scanner 114. The cassette 210 inside the lower housing 111 includes a pivotal lift plate 211 and a lifting mechanism 212 which moves the downstream end (the right end in FIG. 1) of the lift plate 211 up and down inside the cassette 210. The user may place a stack of the sheets S on the lift plate 211. Accordingly, if the lifting mechanism 212 pushes up the downstream end of the lift plate 211, the sheet S is conveyed from the cassette 210.

The copying machine 100 further includes a manual tray 220 which is pivotally attached to the right plate of the lower housing 111. The user may set a sheet S on the manual tray 220 which is rotated so as to project from the right plate of the lower housing 111. The sheet S on the manual tray 220 is pulled into the lower housing 111. The copying machine 100 carries out the toner image forming process onto the sheet S pulled into the lower housing 111.

The cassette 210 and the manual tray 220 are used as a source of the sheets S. The user may operates the operation panel to select the cassette 210 or the manual tray 220 which stores the sheets S of a desired size. A sheet S disposed in the selected source (the cassette 210 or the manual tray 220) is conveyed inside the lower housing 111 and subjected to the image forming process.

The copying machine 100 further includes a pick-up roller 311 which is situated above the lift plate 211. If the lifting mechanism 212 lifts up the downstream end of the lift plate 211, the sheet S on the lift plate 211 makes contact with the pick-up roller 311. The pick-up roller 311 rotates to eject the sheet S from the cassette 210.

The copying machine 100 further includes a feed roller 312 which is situated after the pick-up roller 311, and a separating roller 313 which is situated near the feed roller 312. The feed roller 312 is situated above the separating roller 313. The sheet S ejected from the cassette 210 by the pick-up roller 311 is conveyed between the feed roller 312 and the separating roller 313. The feed roller 312 rotates so as to convey the sheet S further downstream whereas the separating roller 313 rotates so as to return the sheet S to the cassette 210. Accordingly, if the pick-up roller 311 conveys several superimposed sheets S from the cassette 210, only the sheet S in contact with the feed roller 312 (the uppermost sheet) is conveyed downstream whereas the other sheets S are returned to the cassette 210. Therefore, the sheets S are conveyed downstream one by one.

The copying machine 100 further includes a feed roller 316 which is situated near the base end of the manual tray 220, and a separating roller 317 which is pressed against the feed roller 316. A sheet S on the manual tray 220 is pulled into the lower housing 111 by the feed roller 316. The sheet S pulled into the lower housing 111 by the feed roller 316 passes between the feed roller 316 and the separating roller 317. If the feed roller 316 pulls several sheets S into the lower housing 111, the separating roller 313, conversely, rotates so as to return the sheets S to the manual tray 220. Accordingly, only the sheet S in contact with the feed roller 316 (the uppermost sheet S) is pulled into the lower housing 111. Therefore, the sheets S are conveyed into the lower housing 111 from the manual tray 220 one by one.

The copying machine 100 further includes an image forming unit 400 which forms images on sheets S, and a pair of registration rollers 318 which convey the sheet S to the image forming unit 400. A sheet S ejected from the cassette 210 or the manual tray 220 is conveyed towards the registration roller pair 318. The image forming unit 400 at the downstream of the registration roller pair 318 forms a toner image in response to the digital signals output from the scanner 114, and then transfers the toner image to the sheet S. The paired registration rollers 318 convey the sheet S to the image forming unit 400 in synchronism with the image forming process by the image forming unit 400. Therefore, the toner image is formed at a prescribed position on the sheet S.

The image forming unit 400 includes a substantially cylindrical photosensitive drum 410. As described below, the rotatable photosensitive drum 410 includes a rotation shaft and is supported inside the lower housing 111. After an electrostatic latent image is formed on the circumferential surface of the photosensitive drum 410, a toner image, which is coincident with the electrostatic latent image, is formed. The photosensitive drum 410 then rotates with holding the toner image, so that the toner image is transferred onto a sheet S conveyed into the image forming unit 400 by the registration roller pair 318.

The image forming unit 400 further includes a charger 411 and an exposure apparatus 412. The charger 411 uniformly charges the circumferential surface of the photosensitive drum 410. The exposure apparatus 412 irradiates laser light onto the circumferential surface of the photosensitive drum 410 in response to the digital signals output from the scanner 114. Because the charges disappear where the laser light is irradiated, an electrostatic latent image coincident with the image on the original document is formed on the circumferential surface of the photosensitive drum 410.

The image forming unit 400 further includes a toner container 413 which contains toner, and a developing apparatus 414 which supplies the toner conveyed from the toner container 413 to the photosensitive drum 410. The developing apparatus 414 supplies the toner to the photosensitive drum 410 which rotates with holding the electrostatic latent image. The toner supplied from the developing apparatus 414 to the photosensitive drum 410 electrostatically adheres to the circumferential surface of the photosensitive drum 410. Accordingly, a toner image is formed on the circumferential surface of the photosensitive drum 410.

The image forming unit 400 further includes a transfer roller 415 which is pressed against the photosensitive drum 410. The paired registration rollers 318 convey a sheet S in between the photosensitive drum 410 and the transfer roller 415. The transfer roller 415 applies a bias, which is an opposite bias to the toner carried by the photosensitive drum 410, to the sheet S. Accordingly, the toner is electrically separated from the photosensitive drum 410 so that the toner image is transferred onto the sheet S. Then, the photosensitive drum 410 and the transfer roller 415 convey the sheet S downstream.

The image forming unit 400 further includes a cleaning apparatus 416 and a neutralization device 417. The cleaning apparatus 416 removes toner remaining on the circumferential surface of the photosensitive drum 410 after the transfer of the toner image to the sheet S. Then, the neutralization device 417 removes the charges from the cleaned circumferential surface of the photosensitive drum 410. The photosensitive drum 410 is then charged uniformly again by the charging device 411 to carry out another image formation process.

The copying machine 100 further includes a fixing apparatus 500 which fixes the toner image formed by the image forming unit 400 on the sheet S. The fixing apparatus 500 at the downstream of the image forming unit 400 includes a heating roller 510 which has a built-in heater 511 and a pressure roller 520 which is pressed against the heating roller 510. The photosensitive drum 410 and the transfer roller 415 convey the sheet S in between the heating roller 510 and the pressure roller 520.

The toner on the sheet S is melted by thermal energy from the heating roller 510. The toner image is fixed onto the sheet S by pressure caused between the heating roller 510 and the pressure roller 520. The heating roller 510 and the pressure roller 520 then convey the sheet S downstream.

The copying machine 100 further includes an ejection portion 600 situated at the downstream of the fixing apparatus 500. The ejection portion 600 includes paired ejection rollers 610. If a user uses the operating panel to instruct a single-side printing to the copying machine 100, the paired ejection rollers 610 eject the sheet S from the fixing apparatus 500 to the space R. If the user uses the operating panel to instruct a double-side printing to the copying machine 100, the paired ejection rollers 610 perform a switch-back operation for switching the rotational direction between a direction for ejecting the sheet S to the space R and a direction for pulling the sheet S back inside the connection housing 113.

The copying machine 100 further includes a feed path 320 which guides a sheet S from the cassette 210 and/or the manual tray 220 to the registration roller pair 318, and a return path 319 which is formed along the right plate of the main housing 110. The return path 319 formed in the main housing 110 guides a sheet S toward the registration roller pair 318 again after the image formation on the sheet S by the image forming unit 400. The lower end (downstream end) of the return path 319 is connected to the feed path 320. The sheet S which is pulled back inside the connection housing 113 by the switch-back operation under the double-side printing instruction by the user moves along the return path 319, and is then conveyed to the upstream of the registration roller pair 318. Thereafter, the sheet S passes through the image forming unit 400 and the fixing apparatus 500. Accordingly, toner images are formed on both surfaces of the sheet S. The sheet S subjected to the double-side printing process is ejected to the space R by the paired ejection rollers 610.

(Frame Structure)

Figure 2:
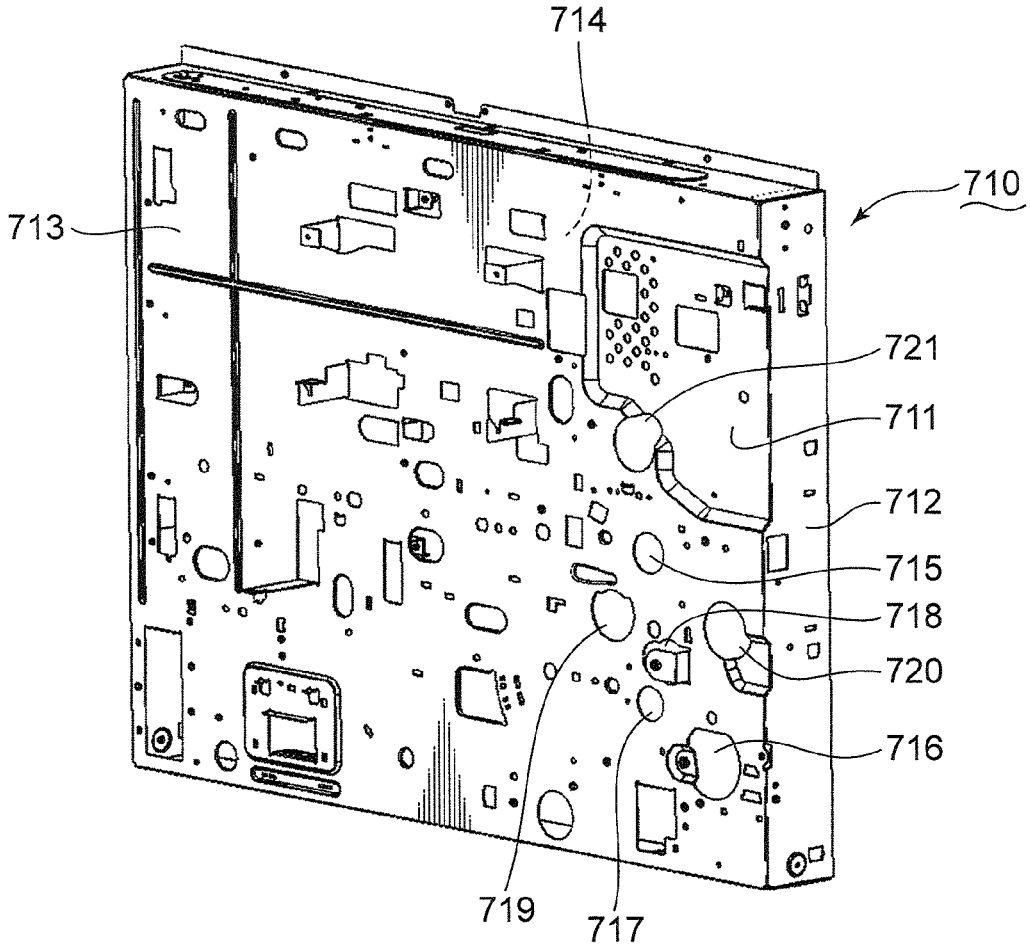
FIG. 2 is a schematic perspective view of a frame configured to support various elements of the image forming apparatus shown in FIG. 1.

FIG. 2 is a schematic perspective view of a frame configured to support elements of the copying machine 100 shown in FIG. 1. The frame is described with reference to FIGS. 1 and 2.

The main housing 110 includes the conductive frame 710. The frame 710 forms an internal wall of the main housing 110. Various elements such as the feed roller 312, the registration roller pair 318 and the paired conveyance rollers 321 are mounted on the frame 710. The frame 710 includes a substantially rectangular main plate 711, and a side plate 712 which is bent and projects perpendicularly from the peripheral edge of the main plate 711. The main plate 711 includes a first surface 713, on which various elements such as the feed roller 312, the registration roller pair 318 and the paired conveyance rollers 321 are mounted, and a second surface 714 opposite to the first surface 713. A drive mechanism described below is mounted on the second surface 714 which is surrounded by the side plate 712. As described above, the feed roller 312, the paired registration rollers 318 and the paired conveyance rollers 321 are used to convey the sheet S to the image forming unit 400. Therefore, in the present embodiment, the feed roller 312, the registration roller pair 318 and the conveyance roller pair 321 are exemplified as a conveyance portion. The paired registration rollers 318 which convey the sheet S to the image forming unit 400 in synchronism with the image forming process by the image forming unit 400 are exemplified as a feed timing adjustor. The feed roller 312 which feeds sheets to the paired registration rollers 318 is exemplified as a sheet feeder. The paired conveyance rollers 321 which eject the sheet S guided by the return path 319 to the registration roller pair 318 in double-side printing are exemplified as the conveyance portion.

Several through holes are formed in the main plate 711 to connect various elements mounted on the first surface 713 with the drive mechanism which drives the elements. The through holes include, for example: a through hole 716 which causes a gear to appear on the side of the first surface 713 and drive the feed roller 316 for feeding a sheet S from the manual tray 220 into the lower housing 111; a through hole 717 which causes a rotation shaft to appear on the side of the first surface 713 so that the feed roller 312 is attached to the rotation shaft to feed a sheet S from the cassette 210; a through hole 718 which causes a gear to appear on the side of the first surface 713 and drive the paired registration rollers 318 situated on the upstream of the image forming unit 400; a through hole 719 which causes a gear to appear on the side of the first surface 713 and drive the developing apparatus 414; a through hole 715 used to connect the photosensitive drum 410 with the drive mechanism; a through hole 720 which causes a gear to appear on the side of the first surface 713 and drive the paired conveyance rollers 321 for conveying a sheet S along the return path 319; and a through hole 721 which causes a gear to appear on the side of the first surface 713 and drive the heating roller 510 of the fixing apparatus 500.

Figure 3:
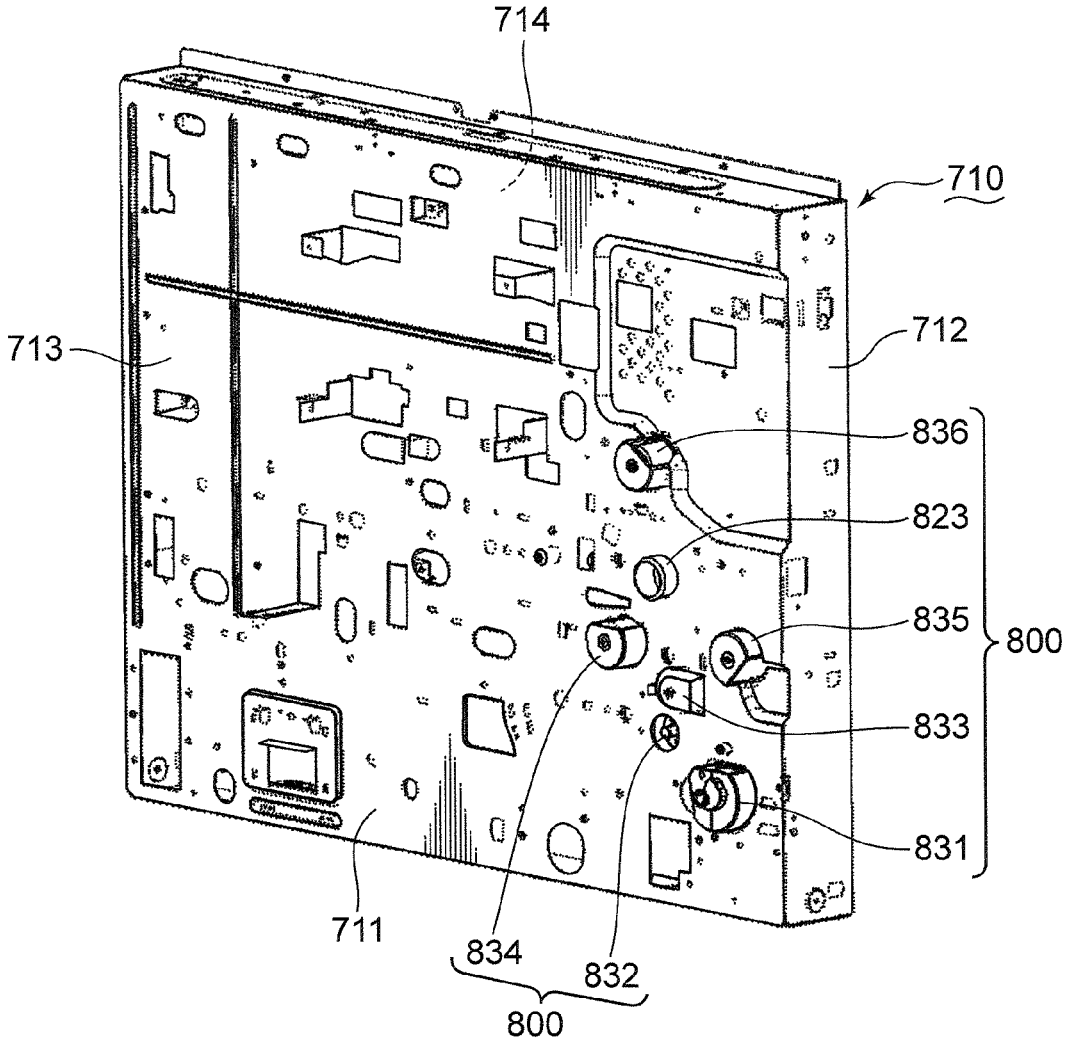
FIG. 3 is a schematic perspective view of the frame to which a drive mechanism is mounted to drive various elements of the image forming apparatus shown in FIG. 1.

FIG. 3 is a schematic perspective view of the frame 710 onto which the drive mechanism is mounted. The frame 710 is further described with reference to FIGS. 1 to 3.

The drive mechanism 800 includes a gear 831 which drives the feed roller 316 to feed a sheet S from the manual tray 220 to the lower housing 111. The gear 831 projects to the first surface 713 through the through hole 716, and engages with a gear (not shown) provided on the feed roller 316.

The drive mechanism 800 further includes a gear 833 which is used to drive the paired registration rollers 318. The gear 833 projects to the first surface 713 through the through hole 718, and engages with a gear (not shown) provided on the paired registration rollers 318. As described hereinafter, the rotation of the gear 833 is controlled by an electromagnetic clutch. In the present embodiment, the gear 833 which outputs a drive force to the registration roller pair 318 is exemplified as the first output portion.

The drive mechanism 800 further includes a rotation shaft 832 on which the feed roller 312 is mounted to supply a sheet S from the cassette 210. The rotation shaft 832 projects on the side of the first surface 713 through the through hole 717. As described hereinafter, the rotation of the rotation shaft 832 is controlled by the electromagnetic clutch. In the present embodiment, the rotation shaft 832 which outputs a drive force to the feed roller 312 is exemplified as the second output portion.

The drive mechanism 800 further includes a gear 834 which is used to drive the developing apparatus 414. The gear 834 projects to the first surface 713 through the through hole 719, and engages with a gear (not shown) provided in the developing apparatus 414.

The drive mechanism 800 further includes a gear 835 for driving the paired conveyance rollers 321 to convey a sheet S along the return path 319. The gear 835 projects on the side of the first surface 713 through the through hole 720. As shown in FIG. 1, the copying machine 100 includes one or more conveyance roller pairs 321 which are provided along the return path 319. The gear 835 engages with a gear (not shown) which is provided on the lowermost (furthest downstream) conveyance roller pair 321. The other conveyance roller pairs 321 are connected to the lowermost conveyance roller pair 321 by means of a drive belt. As described hereinafter, the rotation of the gear 835 is controlled by the electromagnetic clutch. In the present embodiment, the gear 835 which outputs the drive force to the conveyance roller pair 321 is exemplified as the third output portion.

The drive mechanism 800 includes a positioning cylinder 823 for positioning the photosensitive drum 410 with respect to the frame 710. The positioning cylinder 823 projects on the side of the first surface 713 through the through hole 715. The rotation shaft (not shown) of the photosensitive drum 410 is inserted into the positioning cylinder 823 and transmits a drive force from the drive mechanism 800.

The drive mechanism 800 further includes a gear 836 for driving the heating roller 510 of the fixing apparatus 500. The gear 836 projects on the side of the first surface 713 through the through hole 721. The gear 836 engages with a gear (not shown) which is provided on the heating roller 510 of the fixing apparatus 500.

As described above, the gear 833 which outputs the drive force to the registration roller pair 318, the rotation shaft 832 which outputs the drive force to the feed roller 312 and the gear 835 which outputs the drive force to the conveyance roller pair 321 are exemplified as the output portion which controls transmission of the drive force by means of the electromagnetic clutch. Alternatively, another element may be used as the output portion if the transmission of the drive force is controlled by the electromagnetic clutch.

The conveyance portion transmits the drive force from the drive mechanism 800 under the control of the electromagnetic clutch. Alternatively, the principles of the present embodiment may be applied to another processing apparatus which carries out other processes on the basis of the drive force which is transmitted under the control of the electromagnetic clutch.

(Drive Mechanism)

Figure 4:
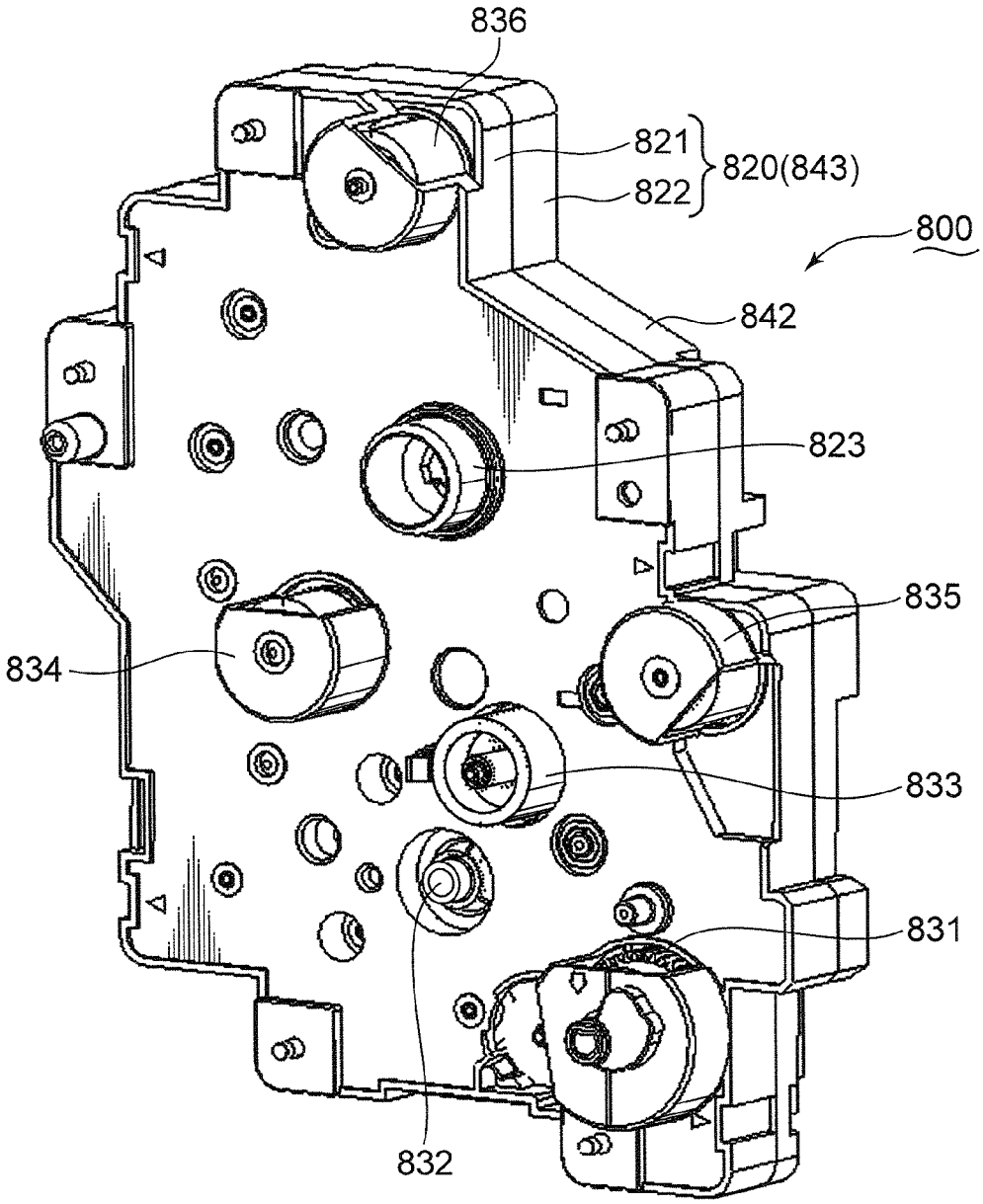
FIG. 4 is a schematic perspective view of a driving mechanism configured to drive the various elements of the image forming apparatus shown in FIG. 1.

FIG. 4 is a perspective view of the drive mechanism 800 from the side of the main plate 711. The drive mechanism 800 is described with reference to FIG. 4.

The drive mechanism 800 includes a motor (described below), which is used as a drive source to cause a drive force transmitted to the gears 831, 833, 834, 835 and 836, and the rotation shaft 832, a transmission section (described below), which transmits the drive force from the motor to the gears 831, 833, 834, 835 and 836, and the rotation shaft 832, and a case 820 which stores the transmission section, in addition to the gears 831, 833, 834, 835 and 836, the rotation shaft 832 and the positioning cylinder 823 described above. The case 820 includes a first shell 821 and a second shell 822. The first shell 821 is situated between the main plate 711 of the frame 710 and the second shell 822.

Figure 5:
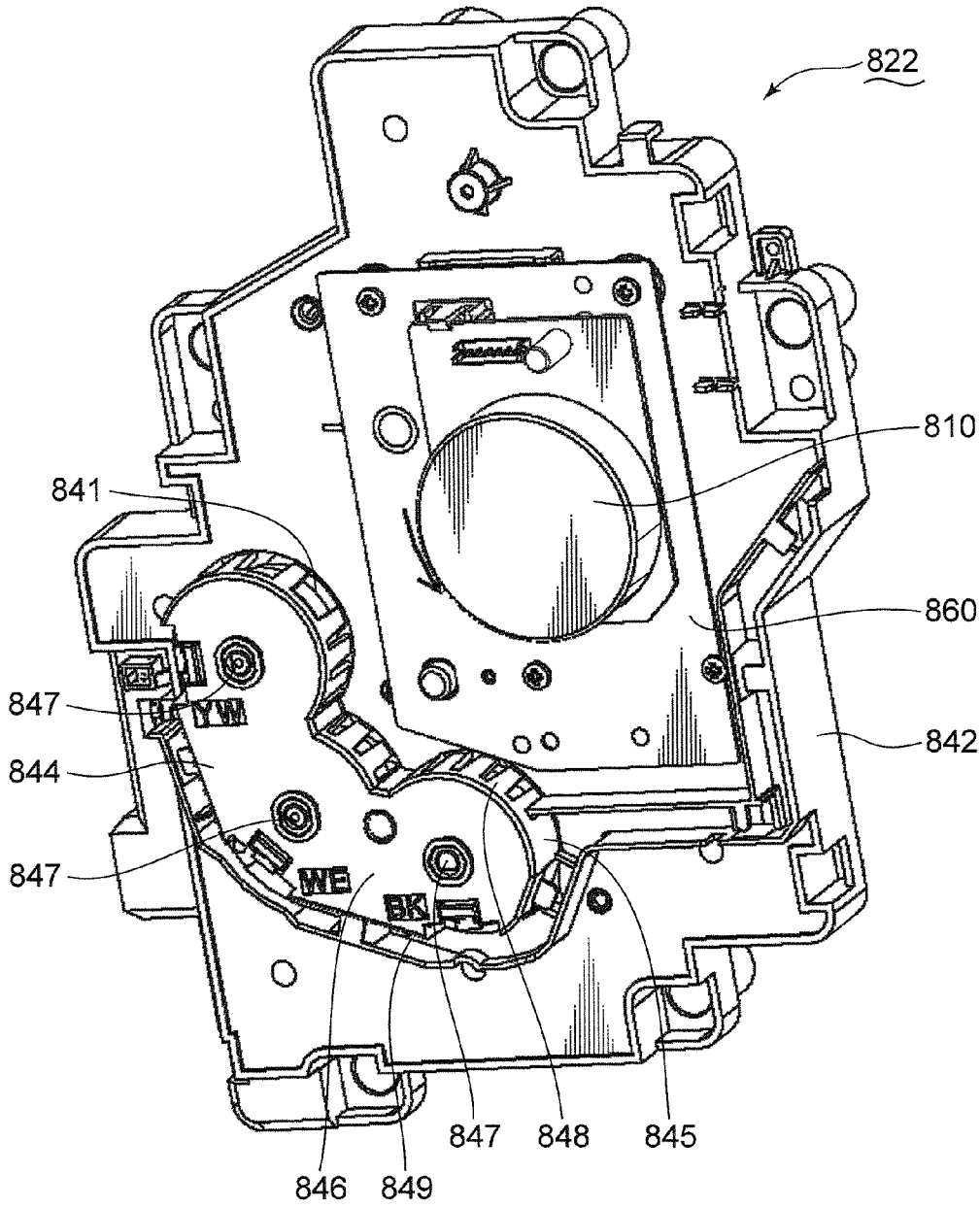
FIG. 5 is a schematic perspective view of a second shell of the drive mechanism shown in FIG. 4.

FIG. 5 is a schematic perspective view of the second shell 822. The drive mechanism 800 is further described with reference to FIGS. 4 and 5.

The second shell 822 includes a main part 842 which overlaps with the first shell 821 to form a first storage section 843. The first storage section 843 forms a first storage room in which the transmission section is stored. The gears 831, 833, 834, 835, 836 and the rotation shaft 832 are partially stored in the first storage room.

The second shell 822 further includes a second storage section 844 which projects outwards from the main part 842. The second storage section 844 forms a second storage room to store the electromagnetic clutches (described below) which control the transmission of the drive force to the gears 833, 835 and the rotation shaft 832.

The second storage section 844 includes a peripheral wall 845 which projects outwards from the main part 842. The peripheral wall 845 surrounds the electromagnetic clutches inside the second storage room. In the present embodiment, the peripheral wall 845 defines the substantially L-shaped second storage room. Three electromagnetic clutches are stored in the second storage room.

The second storage section 844 includes a supporting wall 846 to support the electromagnetic clutch inside the second storage room. The supporting wall 846 is connected to the front edge of the peripheral wall 845, which defines the L-shaped second storage room, and closes the second storage room. FIG. 5 shows a fixing element 847 configured to fix the electromagnetic clutch inside the second storage room to the supporting wall 846.

The peripheral wall 845 includes an upper wall 848 which is situated above the electromagnetic clutch inside the second storage room and a lower wall 849 which is situated below the electromagnetic clutch inside the second storage room. one or more opening sections 841 are formed in the upper wall 848. The opening section 841 extends from the main part 842 toward the supporting wall 846. Heat caused by the electromagnetic clutch inside the second storage room is appropriately exhausted outside the case 820 through the opening sections 841.

In addition to the aforementioned motor 810, the drive mechanism 800 further includes a supporting plate 860 configured to support the motor 810. The motor 810 is mounted on the outer surface of the main part 842 by means of the supporting plate 860. The shaft of the motor 810 is inserted into the first storage room which is formed by the first and second shells 821, 822 to transmit the drive force to the transmission section.

Figure 6:
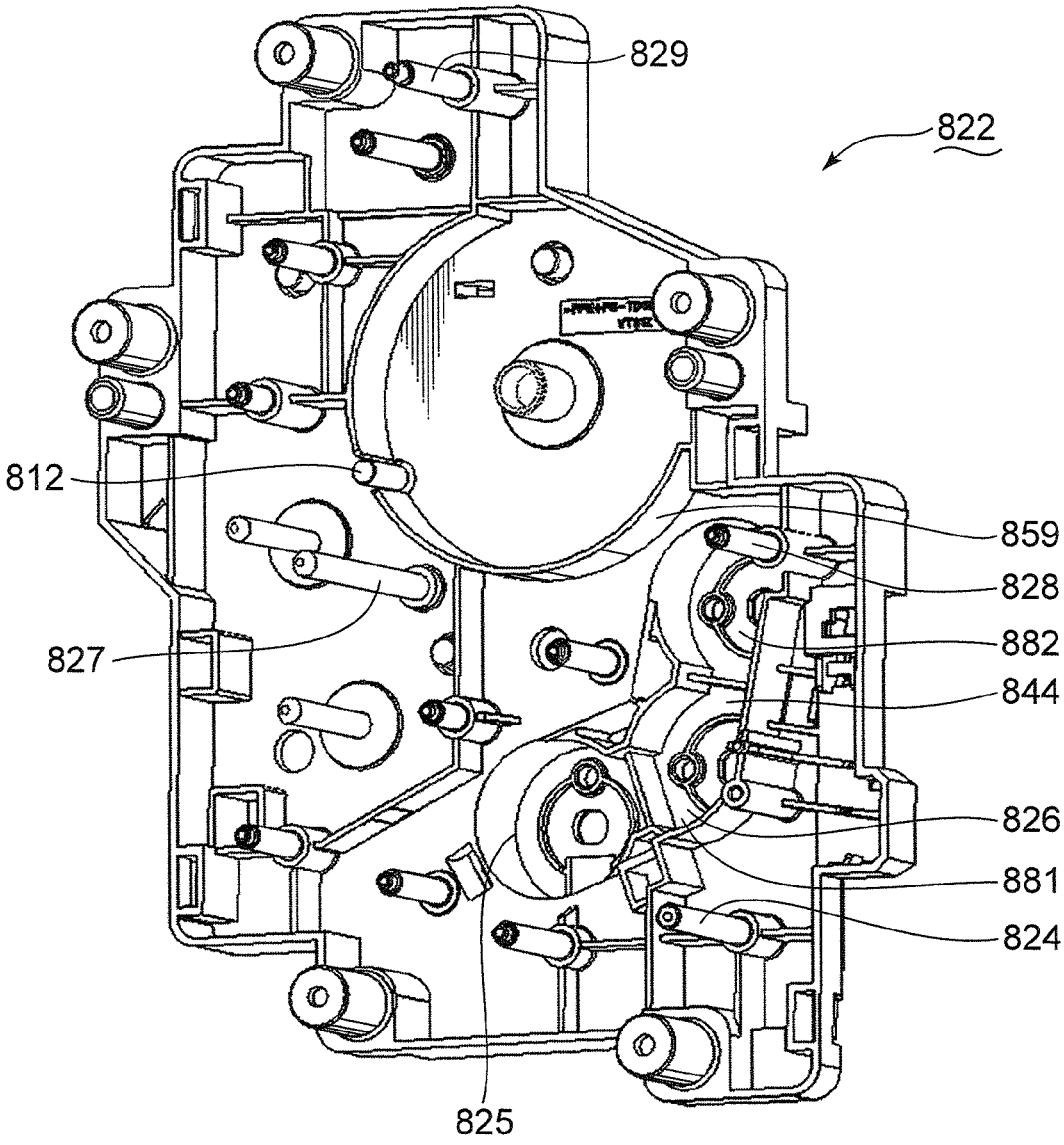
FIG. 6 is a schematic perspective view of an internal structure of the second shell shown in FIG. 5.
Figure 7:
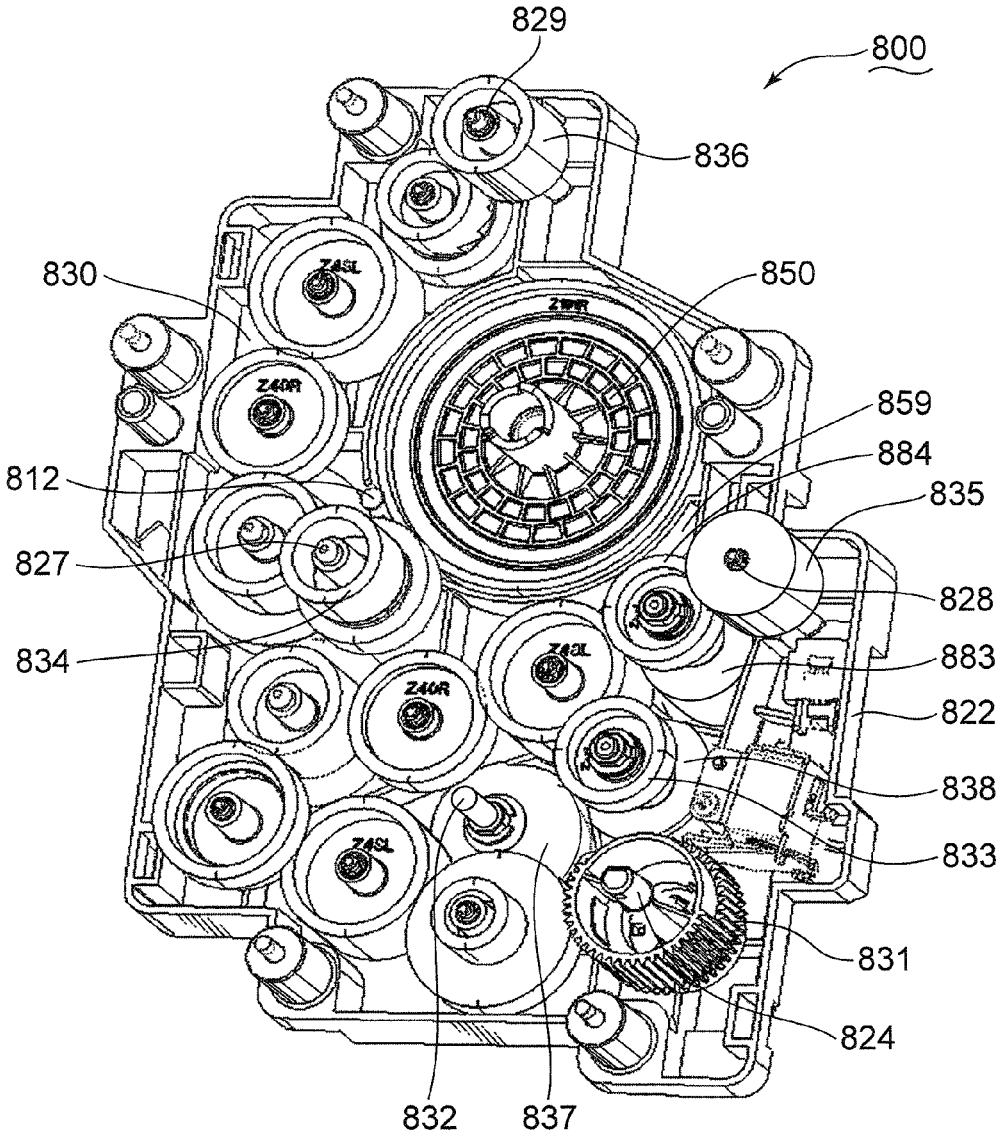
FIG. 7 is a schematic perspective view of an internal structure of the drive mechanism shown in FIG. 4.

FIG. 6 is a perspective view showing the internal structure of the second shell 822. FIG. 7 is a perspective view of the transmission section which is constructed on the inner surface side of the second shell 822. The second shell 822 and the transmission section are described below with reference to FIG. 1 and FIGS. 4 to 7.

The drive mechanism 800 includes the electromagnetic clutch, as described above. The electromagnetic clutch includes a first electromagnetic clutch which controls the transmission of the drive force to the paired registration rollers 318, a second electromagnetic clutch which controls the transmission of the drive force to the rotation shaft 832 to rotate the feed roller 312, and a third electromagnetic clutch which controls the transmission of the drive force to the conveyance roller pairs 321 which are arranged along the return path 319.

As described above, the second storage section 844 of the second shell 822 defines the second storage room 881 to store the electromagnetic clutches. The second storage room 881 includes a first space 826 where the first electromagnetic clutch is stored, a second space 825 where the second electromagnetic clutch is stored, and a third space 882 where the third electromagnetic clutch is stored.

The first electromagnetic clutch is connected to the gear 838. If the first electromagnetic clutch displaces the gear 838 toward the gear 833 for driving the registration roller pair 318, the gear 833 rotates. Accordingly, the paired registration rollers 318 rotate. In the present embodiment, the gear 838 is exemplified as the first output portion in addition to the gear 833.

The second electromagnetic clutch is connected to the gear 837. The gear 837 and the rotation shaft 832 which is connected to the gear 837 rotate in response to on/off switching operation of the second electromagnetic clutch. In the present embodiment, the gear 837 is exemplified as the second output portion in addition to the rotation shaft 832.

The third electromagnetic clutch is connected to the gear 883. The third electromagnetic clutch displaces the gear 883 toward the gear 884 which is arranged coaxially with the gear 883. Accordingly, the gear 884 engaging with the gear 835 rotates and drives the conveyance roller pairs 321, which convey the sheet S along the return path 319. Therefore, the gear 835 rotates, so that the drive force is transmitted to the conveyance roller pairs 321. In the present embodiment, the gears 883, 884 are exemplified as the third output portion in addition to the gear 835.

The second shell 822 further includes a shaft 824 which supports the gear 831, a shaft 827 which supports the gear 834, a shaft 828 which supports the gear 835 and a shaft 829 which supports the gear 836. Besides these shafts and spaces, the second shell 822 further includes a space for supporting or storing several gears, which transmits the drive force to the aforementioned gears. The transmission section 830 is constituted by one or more gears which are placed in the second shell 822. The transmission section 830 includes a main gear 850 which is the largest in diameter among the gears placed in the second shell 822. The second shell includes a wall 859, which defines a space to store the main gear 850. The main gear 850 is used to rotate the photosensitive drum 410.

The transmission section 830 includes a drive gear 812 which is connected coaxially to the shaft of the motor 810. The various gears inside the first storage room receive the drive force from the drive gear 812 and are rotated, respectively.

Figure 8:
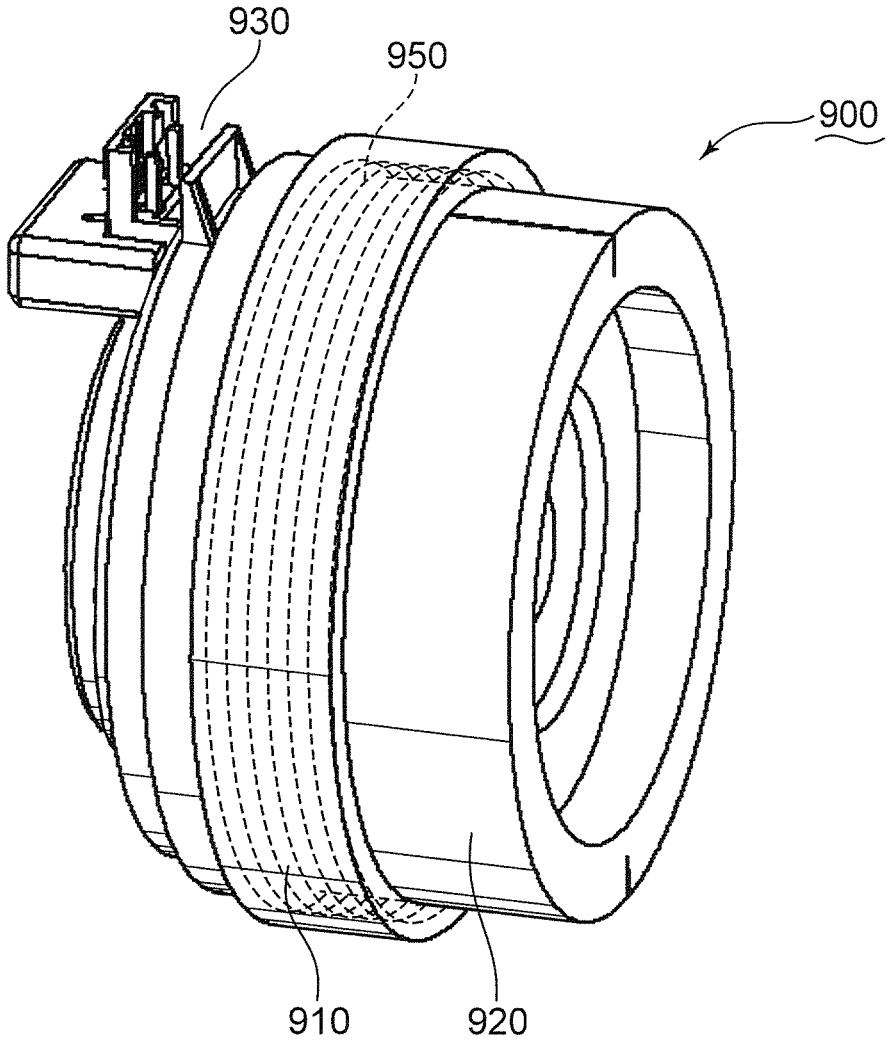
FIG. 8 is a schematic perspective view of an electromagnetic clutch of the drive mechanism shown in FIG. 4.

FIG. 8 is a schematic perspective view of the electromagnetic clutch which is used as the first, second and/or third electromagnetic clutches described above. The electromagnetic clutch is described with reference to FIGS. 5 and 8.

The electromagnetic clutch 900 includes a metallic shell 910, a gear section 920 which is arranged beside the shell 910, and a connection port 930 which receives current from a power supply (not shown). A coil 950 through which current from the connection port 930 flows and other elements provided in a general electromagnetic clutch are arranged inside the shell 910.

The gear section 920 may be controlled in response to the current supply to the electromagnetic clutch 900. Alternatively, the gear section 920 may be displaced and pushed out from the shell 910 in response to the current supply to the electromagnetic clutch 900. Accordingly, the transmission of the drive force through the gear section 920 is appropriately controlled.

Since the shell 910 is metallic as described above, the heat caused from the electronic elements inside the shell 910 is efficiently radiated outside the shell 910. The upper wall 848 of the second storage section 844 is adjacent to the shell 910. The opening sections 841 are formed in the upper wall 848 are situated above the shell 910. Therefore the heat from the shell 910 is efficiently radiated outside the case 820 through the opening sections 841.

In addition, the upper wall 848 prevents dust (such as toner) floating around the electromagnetic clutch 900 from entering into the electromagnetic clutch 900. Air heated by the electromagnetic clutch 900 as described above causes an elevating air flow from the opening sections 841, so that the warm air exhausted outside the case 820 also suppresses the infiltration of the dust into the electromagnetic clutch 900, in addition to the upper wall 848. Accordingly, it becomes less likely that dust adherence to the electromagnetic clutch 900 causes abnormal noise of the electromagnetic clutch 900.

Since the opening sections 841 are only provided in the upper wall 848, it becomes less likely that wear chips of the electromagnetic clutch 900 generated during the operations of the electromagnetic clutch 900 and grease used for smooth operations of the electromagnetic clutch 900 are scattered outside the case 820.

This application is based on Japanese Patent applications No. 2010-258871 and 2011-103658 filed in Japan Patent Office on Nov. 19, 2010 and May 6, 2011, the contents of which are hereby incorporated by reference.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A drive mechanism for transmitting a drive force to drive a processing apparatus which carries out a prescribed process, comprising:

an output portion configured to output the drive force;

an electromagnetic clutch configured to control transmission of the drive force to the output portion; and a case including a first storage section which defines a first storage room to store the output portion, and a second storage section which defines a second storage room to store the electromagnetic clutch, wherein the second storage section includes a peripheral wall which projects outwards from the first storage section to surround the electromagnetic clutch, and a supporting wall which supports the electromagnetic clutch;

the peripheral wall includes an upper wall above the electromagnetic clutch and a lower wall below the electromagnetic clutch; and an opening section is formed only in the upper wall.

2. The drive mechanism according to claim 1, wherein the electromagnetic clutch includes a coil to which electric current is supplied to electrically control the transmission of the drive force and a metallic shell which surrounds the coil; and the opening section is formed above the shell.

3. An image forming apparatus for forming an image, comprising:

an image forming unit configured to form an image on a sheet;

a conveyance portion configured to convey the sheet to the image forming unit; and a drive mechanism configured to transmit a drive force to the conveyance portion, wherein the drive mechanism includes:

an output portion configured to output the drive force;

an electromagnetic clutch configured to control transmission of the drive force to the output portion; and a case including a first storage section which defines a first storage room to store the output portion, and a second storage section which defines a second storage room to store the electromagnetic clutch;

the second storage section includes a peripheral wall which projects outwards from the first storage section to surround the electromagnetic clutch, and a supporting wall which supports the electromagnetic clutch;

the peripheral wall includes an upper wall above the electromagnetic clutch and a lower wall below the electromagnetic clutch; and an opening section is formed in the upper wall.

4. The image forming apparatus according to claim 3, wherein the conveyance portion includes an feed timing adjustor which matches a conveyance timing of the sheet to the image forming unit with an image formation timing by the image forming unit;

the output portion includes a first output portion which outputs the drive force to the feed timing adjustor; and the electromagnetic clutch includes a first electromagnetic clutch which controls the transmission of the drive force to the first output portion.

5. The image forming apparatus according to claim 4, wherein the conveyance portion includes a sheet feeder which feeds the sheet to the feed timing adjustor;

the output portion includes a second output portion which outputs the drive force to the sheet feeder; and the electromagnetic clutch includes a second electromagnetic clutch which controls the transmission of the drive force to the second output portion.

6. The image forming apparatus according to claim 5, further comprising:

a main housing in which a return path is formed to guide the sheet to the feed timing adjustor after image formation on the sheet by the image forming unit, wherein the conveyance portion includes a conveyance portion which conveys the sheet along the return path;

the output portion includes a third output portion which outputs the drive force to the conveyance portion; and the electromagnetic clutch includes a third electromagnetic clutch which controls the transmission of the drive force to the third output portion.

7. The drive mechanism according to claim 1, wherein the opening section opens upward.

* * * * *